US005096060A

United States Patent [19]

Vavra

[11] Patent Number: 5,096,060

[45] Date of Patent: Mar. 17, 1992

[54] PACKAGING SYSTEM FOR A BASIN, LAVATORY OR SINK

[76] Inventor: Paul P. Vavra, 519 Pine Tree Rd., Kohler, Wis. 53044

[21] Appl. No.: 630,524

[22] Filed: Dec. 20, 1990

[51] Int. Cl.[5] ..... B65D 75/04

[52] U.S. Cl. ..... 206/320; 206/489

[58] Field of Search ..... 206/320, 321, 486, 489; 229/23 R

[56] References Cited

U.S. PATENT DOCUMENTS

| | | | |
|---|---|---|---|
| 2,163,045 | 6/1939 | Lavere . | |
| 2,314,491 | 3/1943 | Greenberg . | |
| 2,397,041 | 3/1946 | Pantalone . | |
| 2,509,447 | 5/1950 | Prawczik . | |
| 2,570,946 | 10/1951 | Hennessey . | |
| 3,084,790 | 4/1963 | Vander Lugt, Jr. . | |
| 3,232,513 | 2/1966 | Maio . | |
| 3,271,357 | 9/1966 | Burt . | |
| 3,289,825 | 12/1966 | Smith | 206/320 |
| 3,361,330 | 1/1968 | Arneson . | |
| 3,380,644 | 4/1968 | D'Alessio . | |
| 3,481,453 | 12/1969 | Shreve, III et al. . | |
| 3,521,744 | 7/1970 | Smith | 206/320 |
| 3,521,812 | 7/1970 | Moers et al. . | |
| 3,664,494 | 5/1972 | Mergens . | |
| 3,680,688 | 8/1972 | Smith | 206/320 |
| 3,693,866 | 9/1972 | Struble . | |
| 3,705,681 | 12/1972 | Rossi et al. . | |
| 3,757,935 | 9/1973 | Coons et al. | 206/320 |
| 3,773,171 | 11/1973 | Edsall | 206/320 |
| 3,820,708 | 6/1974 | Sieffert . | |
| 3,836,066 | 9/1974 | Del Priore et al. . | |
| 3,845,859 | 11/1974 | Dornbush | 206/320 |
| 3,871,572 | 3/1975 | Skaggs . | |
| 3,964,669 | 6/1976 | Sontag et al. . | |
| 4,019,672 | 4/1977 | Giannini . | |
| 4,039,077 | 8/1977 | Sorenson | 206/320 |
| 4,071,140 | 1/1978 | Rattner . | |
| 4,186,834 | 2/1980 | Krack | 206/320 |
| 4,375,261 | 3/1983 | Kitchell . | |
| 4,457,998 | 3/1986 | Vavra . | |
| 4,493,453 | 1/1985 | LeDrew . | |
| 4,674,633 | 6/1987 | Steadman . | |
| 4,718,545 | 1/1988 | Chrzanowski et al. . | |
| 4,773,539 | 9/1988 | Nock . | |
| 4,798,291 | 1/1989 | Carver . | |
| 4,821,884 | 4/1989 | Griffin et al. . | |
| 4,836,364 | 6/1989 | Hanko et al. . | |
| 4,848,541 | 7/1989 | Paliotta et al. . | |
| 4,895,295 | 1/1990 | Montgomery et al. . | |
| 4,901,849 | 2/1990 | Wilson . | |
| 4,905,820 | 3/1990 | Hart et al. . | |
| 4,925,088 | 5/1990 | Ostrander . | |

FOREIGN PATENT DOCUMENTS

| | | | |
|---|---|---|---|
| 2636454 | 2/1978 | Fed. Rep. of Germany . | |
| 307537 | 1/1969 | Sweden . | |
| 2038274 | 7/1980 | United Kingdom | 206/320 |

*Primary Examiner*—Jimmy G. Foster

*Attorney, Agent, or Firm*—Andrus, Sceales, Starke & Sawall

[57] ABSTRACT

An open-ended nestable shipping container with an integral holding and locating panel and a container blank for forming such a container is disclosed. In one embodiment there is provided an article top panel whose size is larger that the article top such that all panel edges extend beyond all edges of the periphery of the article top rim. A first cavitied panel is connected to the side edge of the article top panel and extends across the article rim underside, whose size is the same or similar to the article top panel. The first cavitied panel consists of one hinged, cut and scored first article side and bottom protector. The second cavitied panel is connected to the side edge of the article first cavitied panel, and is layer folded against the first cavitied panel, whose side is the same or similar to the article first cavitied panel. The second cavitied panel consists of two hinged, cut and scored article end and bottom protectors. The third cavitied panel is connected to the side edge of the second cavitied panel, and is layer folded against the second cavitied panel. The third cavitied panel is the same or similar to the second cavitied panel. The third cavitied panel consists of one hinged, cut and scored second article side and bottom protector. The three open article rim edges allow for visual inspection of the article rim which is inward of the edges of the cavitied holding and locking panels. The two ends can be opened and reclosed for article basin body inspection. The container is especially suitable for shipping fragile and heavy articles such as basins, lavatories or sinks.

8 Claims, 4 Drawing Sheets

FIG. 8
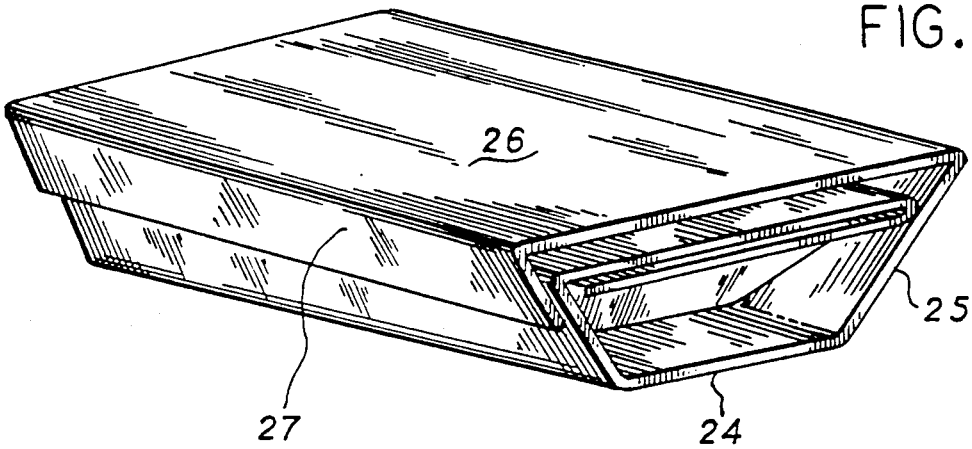
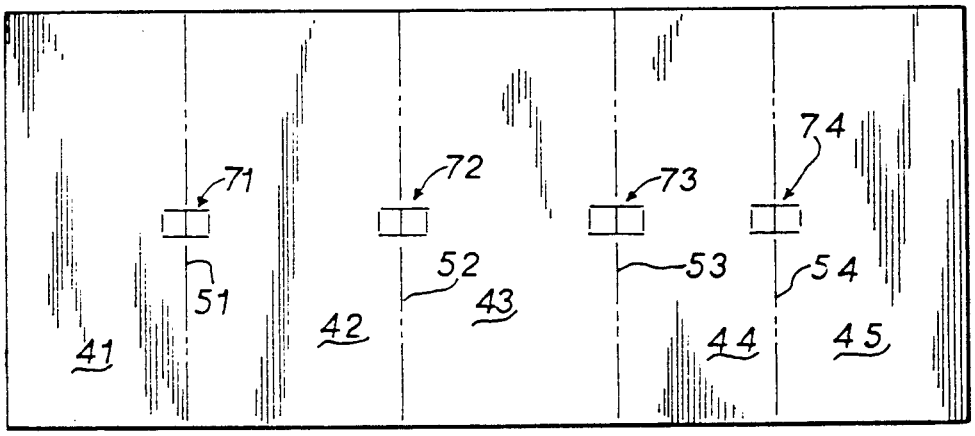
FIG. 9
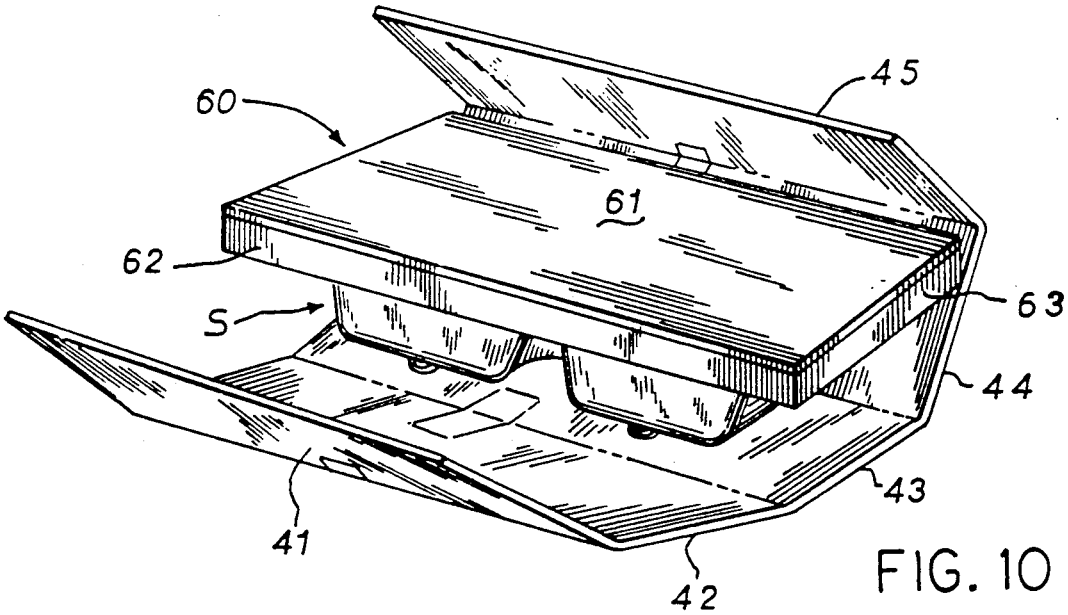
FIG. 10

PACKAGING SYSTEM FOR A BASIN, LAVATORY OR SINK

BACKGROUND OF THE INVENTION

1. Scope of the Invention

This invention relates to an open-ended shipping container for an article such as a basin, lavatory or sink. It also relates to a container blank for forming such a container.

2. Description of the Science

The combination of design, fragility and weight of articles such as porcelain basins, lavatories or sinks result in certain shipping and packaging material waste disposal problems. One problem was that because most prior containers for such articles were fully enclosed, weight was at times mistakenly equated with ruggedness, so that a heavy container would on occasion be mishandled. Verbal and pictorial warnings strategically located on the container were often not believed or simply ignored.

Another problem was that because of the nature of the enclosed container, little discouragement is given to careless handlers in assessing responsibility for damage. In most cases, the damage was not apparent until the container was opened.

Another problem was that the basins, lavatories or sinks are wider at the top than at their bottoms, requiring fillers or spacers so as to prevent the article from tilting or sliding within the container.

Another concern is that of waste disposal. It is desirable for a container to use minimal materials through the most effective use of materials which preferably, are also recyclable.

Another concern is that of energy conservation. It is desirable for a container to use a minimal amount of energy during the manufacture of the container and during the article packaging operation.

Another concern is that of storage area requirements. It is desirable for a container to use minimal material storage area at container manufacturer and article packaging production areas. The container design should allow it be nested both in packaged product warehouse and within the transport vehicle.

It, can therefore, be seen that a need has existed for a more efficient container for articles such as basins, lavatories and sinks.

It is therefore a principal object of the invention to provide an open-ended container with an integral cavitied panel for securely holding an enclosed article in place.

It is another object of the invention to provide a shipping container which:

1. conserves packaging materials;
2. conserves energy in its manufacturing, assembly, storage and shipping;
3. is easily manufactured and constructed into a shipping container;
4. reduces waste disposal and handling;
5. is made of materials which are readily recyclable; and
6. reveals its contents and any damage to prospective handlers.

SUMMARY OF THE INVENTION

The invention refers to an open-ended shipping container (FIG. 3) and a container blank (FIG. 1) for forming such a container. In one aspect, the shipping container has a cut, hinged and creased design in one or more of its panels whose shape is similar to the underside of the article to be shipped. A top panel is located on top of the article top surface and extending across and beyond its outside edges. A first cavitied panel with its hinged article first side and bottom protectors is connected to the top panel adjacent a side edge of the top panel and is suitable to extend across and beyond the article top rim underside. A second cavitied panel with its hinged article first and second end and bottom protectors is connected to the first cavitied panel adjacent a side edge of the first cavity panel and is suitable to be layer folded against the first cavitied panel and extends across and beyond the article's top outside edges. A third cavitied panel with its hinged article second side and bottom protectors is connected to the second cavitied panel adjacent a side edge of the second cavitied panel and is suitable to be layer folded against the second cavitied panel and extends across and beyond the article's top outside edges. The open top rim edges and reopenable ends allow for visual inspection of the article which is inward of the edges of the shipping container blank ends.

In another variation there is provided a blank (FIG. 6) for an open-ended shipping container (FIG. 8) described above. In the blank, two cavitied panels are used. The secondary panel is connected to and layer folded over the first cavitied panel so as to increase article protection, or reduce the material required for a single cavitied panel. In the blank, a first cavitied panel has cut, hinged and creased article end and bottom protectors which extend across and against the underside of both ends and bottom of the article. A secondary cavitied panel is connected to the first cavitied panel adjacent a side edge of the first cavitied panel and is suitable to be layer folded over the first cavitied panel and against the underside of the article top and extends across and beyond the article top outside edges. The secondary panel has cut, hinged and creased article side protectors and end retainers which extend across both sides and ends of the underside of the article. A first side panel which is connected to the secondary cavitied panel adjacent a side edge of the secondary cavitied panel and is suitable to extend across and beyond a first side of the article. A bottom panel is connected to the first side panel adjacent a bottom edge of the first side panel is suitable to extend across and beyond the article bottom. A second side panel is connected to the bottom adjacent a side edge of the bottom panel which is opposite the first side panel and is suitable to extend across and beyond the article side which is opposite the first side. A top panel is connected to the second side panel adjacent a top edge of the second side panel and is suitable to extend across and beyond the article top. A partial first side panel is connected to the top panel adjacent a top edge of the top panel and is suitable to extend across and over the outer surface of the first side panel. The top partial first side panel is secured to the top section of the outside surface of the first side panel, to secure the shipping container for handling, storage and shipment. The open ends allow for visual inspection of the article which is inward of the edges of the blank.

In another variation there is provided a two piece open-ended shipping container (FIG. 11) as described above, consisting of a tray-cap and a blank. Because of the nature of the article design, fragility, material or weight, a separate (individual) tray-cap can be incorporated to retain the article within the open-ended blank. The tray-cap can be formed of one or more pieces of the same or differing materials from the blank. The tray-cap is located over and on the article top, and its sides and ends extend beyond the sides and ends of the article top rim underside. The open-ended blank consists of a number of panels which fold over the article top, sides, bottom and tray-cap top. In the blank, a first article top panel is located over and across to the center of the tray-cap top. A first side panel is connected to the first top panel adjacent a side edge of the first top panel and is suitable to extend across and beyond the article first side and a first side edge of the tray-cap. A bottom panel is connected to the first side panel adjacent a bottom edge of the first side panel and is suitable to extend across and beyond the article bottom. A second side panel is connected to the bottom panel adjacent a side edge of the bottom panel which is opposite the first side panel and is suitable to extend across and beyond the article second side and the second side of the tray-cap which is opposite the first article side. A second top panel is connected to the second side panel adjacent a top edge of the second side panel and is suitable to extend across and to the center of the top of the tray-cap with its edge butted against the edge of the first top panel of blank. The container closure can be of any suitable latitudinally wound and tied band, tape, cord or similar binding as shown, or stitched, or glued to the tray-cap.

The present invention provides a savings in packaging materials by eliminating the need for end walls and article shipping supports and spacers, and by allowing the use of a rectangular shaped blank which reduces waste material in fabrication from raw sheet stock. The resulting open-ended shipping container reveals the article and its condition before and after each particular handling operation. This gives notice that it should be handled carefully, and reveals any damage that might occur during handling and shipping operations. Responsibility for damage is therefore much easier to assess, thereby reducing article damage.

The foregoing and other objects and advantages of the invention will appear in the following detailed description. In the description, reference is made to the accompanying drawings which show, by way of illustration and not limitation, a preferred embodiment of the invention.

BRIEF DESCRIPTION OF THE DRAWINGS

The drawings illustrate the best mode presently contemplated of carrying out the invention.

In the drawings:

FIG. 8 is a perspective view of the blank of FIGS. 6 and 7 shown folded around the article to provide a shipping container of the invention with a variation of any number of closing and securing methods.

FIG. 9 is a top plan view of an unfolded blank used in forming a two-piece container as illustrated in FIGS. 10 and 11, consisting of a tray and a blank.

FIG. 10 is a perspective view of a partially assembled two-piece container showing a tray positioned on top of the article and the folded blank of FIG. 9.

DETAILED DESCRIPTION OF THE PREFERRED EMBODIMENTS

Figure 1:
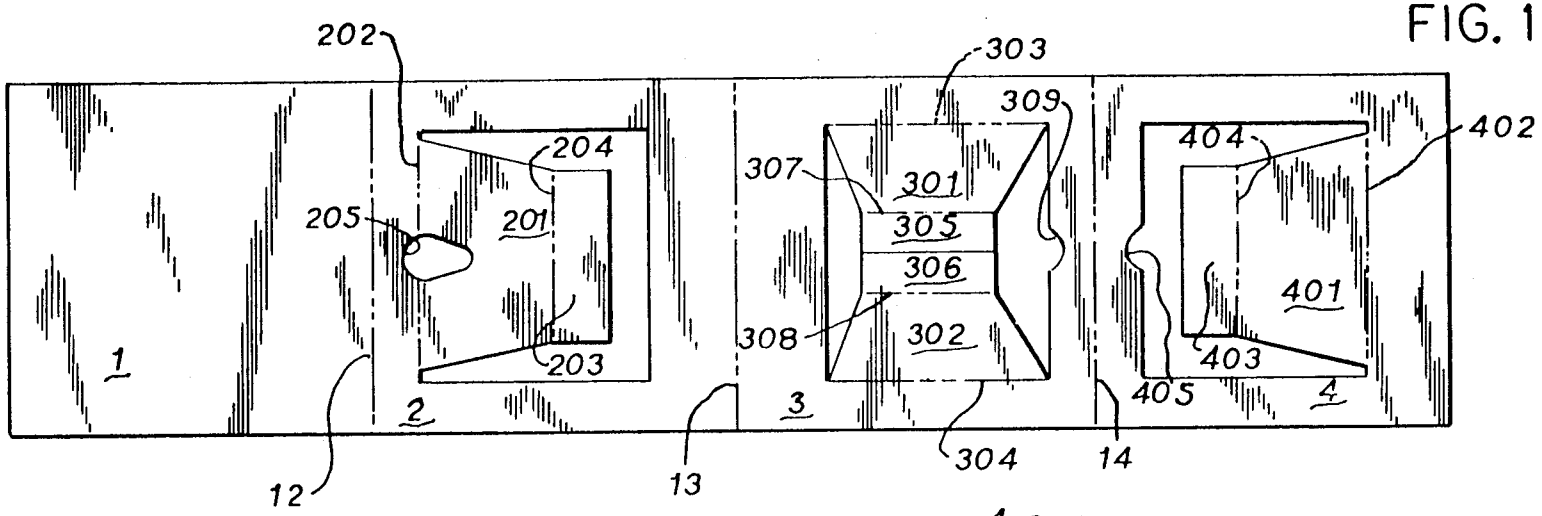
FIG. 1 is a plan view of an unfolded blank for forming a container as shown in FIGS. 2–5.

In the drawing figures, creased or bend lines are shown as broken (dashed) lines and cut lines are indicated by solid lines.

Figure 4:
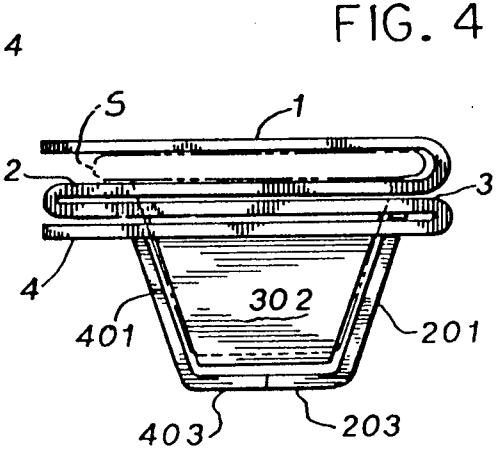
FIG. 4 is an end elevation view of the completed container of FIG. 3.
Figure 3:
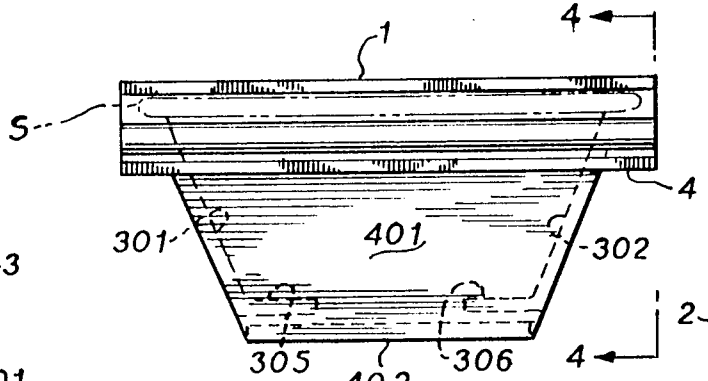
FIG. 3 is a side elevation view of a completed container formed from the fully folded blank of FIG. 1.
Figure 2:
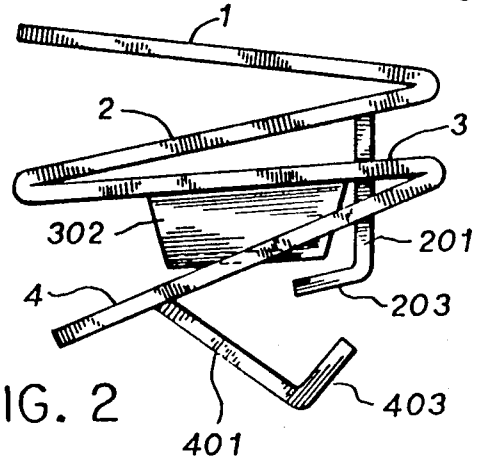
FIG. 2 is an end view of the partially folded blank of FIG. 1.

Referring to FIGS. 1, 2, 6, 7 and 10, a shipping container is shown in various stages of being wrapped around an article. While the invention is especially adapted for heavy and fragile articles like porcelain basins, lavatories and sinks, it could of course be used for any article of varying materials, shapes, sizes and weights. As shown in FIGS. 3 and 4, the article packaged consists of a sink, shown at S.

The container shown in FIGS. 1–5 fits closely around the article top, sides, bottom and ends. Referring to FIG. 1 a top panel 1, which is wider and longer than the article top so as to extend beyond the outer perimeter of the article top rim edges, is connected along a bend line 12 to a first cavitied panel 2. The first cavitied panel 2 extends from blank edge to edge and is adapted for placement against the underside of the article top rim and is connected along a bend line 13 to a second cavitied panel 3. The second cavitied panel 3 extends from blank edge to edge and is adapted to be layer folded against first cavitied panel 2, and is connected along a bend line 14 to a third cavitied panel 4. The third cavitied panel 4 extends from blank edge to edge and is adapted to be layer folded against second cavitied panel 3.

FIGS. 2–5 show how the panels are layer folded and how the article, such as a basin, lavatory or sink, is restrained from motion within the shipping container and protected from abusive handling and shipping. The article is received within the cavitied panels whose shape is that of the underside of the article top rim and basin outer top surfaces. As the article is lowered into the cavitied panels 2, 3 and 4, flaps 201 and 401 of panels 2 and 4, respectively, fold downwardly along bend lines 202 and 402 and against the article front and back sides. Simultaneously, flaps 301 and 302 of panel 3 fold downwardly along bend lines 303 and 304, respectively, and against article ends. Flaps 203 and 403 fold horizontally toward shipping container center along bend lines 204 and 404, respectively, and against the article bottom. Flaps 305 and 306 fold horizontally toward the center of the container along bend lines 307 and 308, respectively, and against the article bottom.

Flaps 201, 301, 302 and 401 protect the article sides and ends while flaps 203, 305, 306 and 403 protect the article bottom, thus eliminating the need for container bottom, end and side walls.

When lower flaps 305 and 306 are folded horizontally about the bottom of the article, the facing inner ends of flaps 305 and 306 are spaced apart from each other, as shown in FIG. 3. The upper surfaces of flaps 305 and 306 engage the bottom of the article. When lower flaps 203 and 403 are folded horizontally about the bottom of the article, the facing inner ends of flaps 203 and 403 are in close proximity to each other, as shown in FIG. 4 and little or no space is present between the ends of flaps 203 and 403. The upper surfaces of flaps 203 and 403 are located adjacent the lower surfaces of flaps 305 and 306, and flaps 203 and 403 cover and protect the entire underside of the article.

An opening 205 is formed in first cavitied panel 2. A portion of opening 205 remains in the plane of panel 2 when flap 201 is folded about bend line 202, with the remainder of openings 205 lying in the plane of flap 201 after folding of flap 201. After the article is placed into the formed container as shown in FIGS. 3 and 4, opening 205 forms a slot to receive an appendage of the article, which is located along the outer underside of the article. Indentations 309 and 405 formed in panels 3 and 4, respectively, cooperate with opening 205 in forming the slot upon folding of panels 3 and 4.

Figure 5:
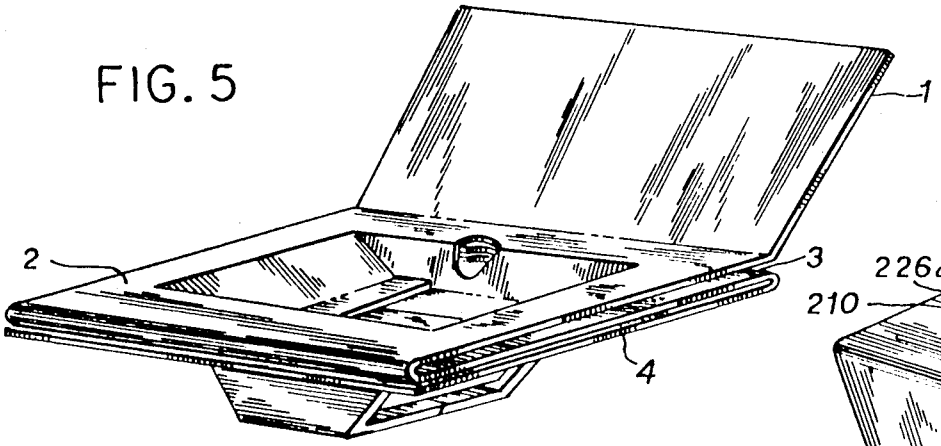
FIG. 5 is a perspective view of the container formed from the blank of FIG. 1, folded to form a container ready to receive the article, prior to article placing and shipping container closure.

FIG. 5 illustrates by design how the container is a storage and truck space saver. Because the container is a pyramidal (pyramid with its apex removed) shape it can be nested by mating the four angular sides with a corresponding side of the adjacent containers thereby obtaining a greater product density per cubic area of space.

Figure 7:
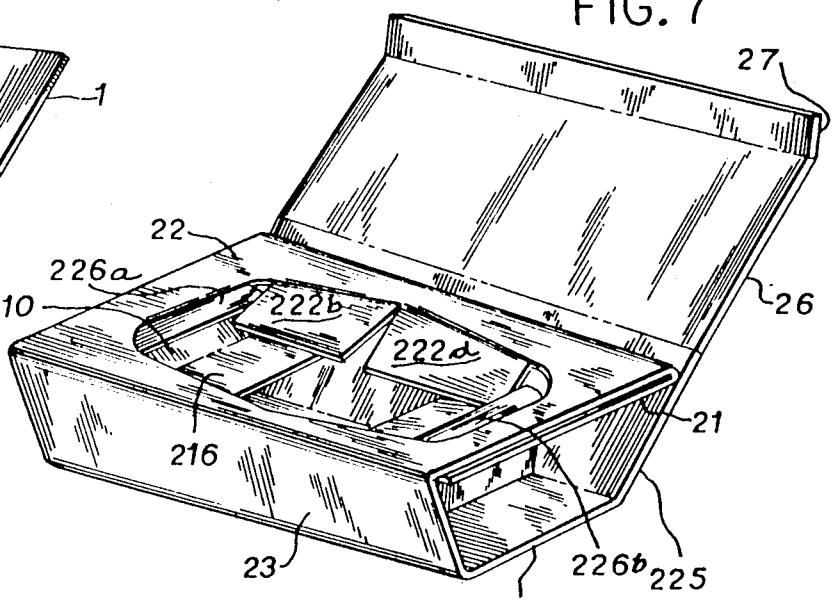
FIG. 7 is a perspective view of the partially folded blank of FIG. 6.
Figure 6:
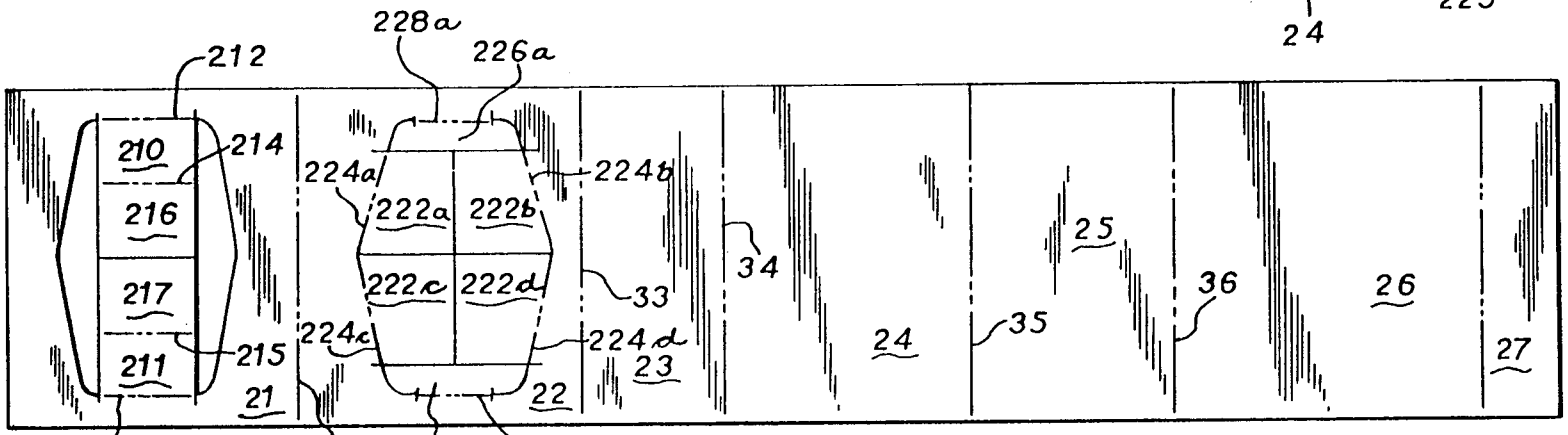
FIG. 6 is a top plan view of the unfolded blank of FIG. 8, which is a second embodiment of the invention to provide increased protection for an article of special design, fragility, material or weight.

In the embodiment of FIGS. 6, 7 and 8, the blank consists of seven panels which include two cavitied panels and a closing panel for increased article protection and container closure flexibility, as may be a requirement for article design, fragility, material and weight. As shown in FIG. 8, the container fits snugly around the article top, sides and bottom. Referring to FIGS. 6 and 7, the cavitied panel 21 which is wider and longer than the article top, and which is adapted to extend beyond the outer perimeter of the underside of the article top, is connected along a bend line 32 to the second cavitied panel 22. The second cavitied panel 22 extends from blank edge to edge and lays flat over and on first cavitied panel 21 and terminates near the article top edge first side, and is connected along bend line 33 to a first side panel 23. The first side panel 23 extends from blank edge to edge and downwardly across the article first side and terminates near the article bottom edge first side, and is connected along a bend line 34 to a bottom panel 24. The bottom panel 24 extends from blank edge to edge and across the article bottom and terminates at the article bottom edge second side, and is connected along a bend line 35 to a second side panel 25. The second side panel 25 extends from blank edge to edge and upwardly across the article second side and terminates near the article top edge and is connected along a bend line 36 to a top panel 26. The top panel 26 extends from blank edge to edge and across the article top and terminates near the top outer edge of the container blank first side panel bend line 33 to a securing and closing panel 27. The securing and closing panel 27 extends from blank edge to edge and downwardly across and against top outer portion of blank first side panel 23. Securing and closing panel 27 is secured to first side panel 23 with adhesives, staples, tape or any other method, as will be explained.

FIG. 7 shows how the article is restrained from motion within the container. The article is received within the cavitied panels 21 and 22, with the shape of the cavities corresponding to that of the underside of the article (top) side and end outer surfaces. The article is lowered into the cavities in cavitied panels 21 and 22, and engages flaps 210 and 211 of cavitied panel 21, which are connected to the panel 21 along bend lines 212 and 213, respectively. Flaps 210 and 211 fold downwardly along bend lines 212 and 213 across and against the article ends and terminate near the article bottom ends. Flaps 210 and 211 are connected along bend lines 214 and 215 to flaps 216 and 217, respectively, of cavitied panel 21. Flaps 216 and 217 which are connected to flaps 210 and 211, respectively, of cavitied panel 21 fold horizontally along bend lines 214 and 215 and terminate under and across the article bottom between the article bottom and bottom panel 24. Simultaneously, flaps **222*a*, 222*b*, 222*c* and 222*d* of cavitied panel 22 fold downwardly along bend lines 224*a*, 224*b*, 224*c* and 224*d*, respectively, and flaps 226*a* and 226*b* fold downwardly along bend lines 228*a* and 228*b*, respectively. Flaps 226*a* and 226*b* fold downwardly against and between flaps 210 and 211 and the article ends, and flaps 222*a*-222*d* fold downwardly against and between panels 23 and 25, and the article sides. The flaps of cavitied panels 21 and 22** not only give added support and formability to the container but they also give the article increased protection along its bottom, ends and sides.

Figure 11:
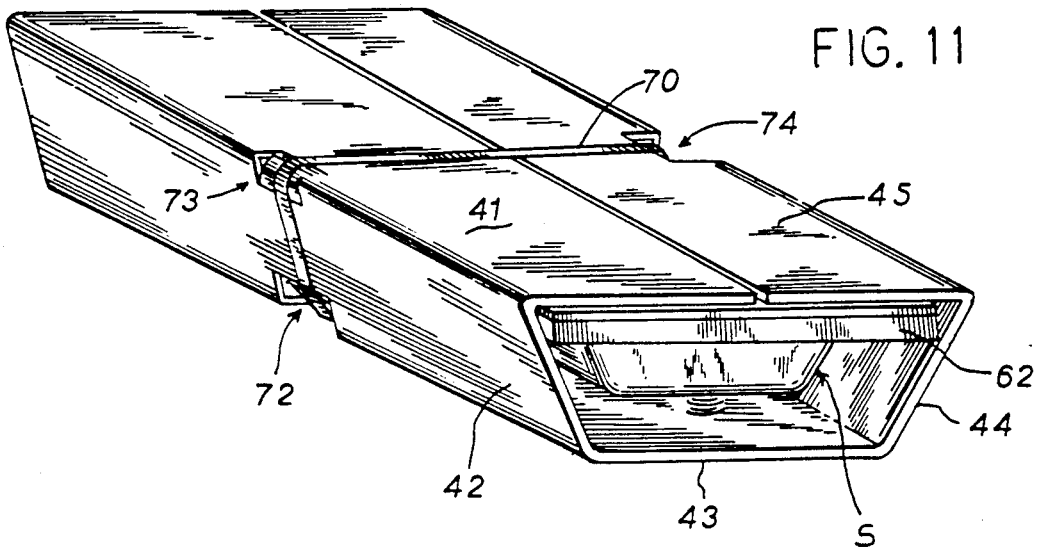
FIG. 11 is a perspective view of the tray and blank of FIG. 10 folded around the article to provide a shipping container of the invention with another style closure and securing method.

The embodiment of FIGS. 9, 10 and 11 consists of a two-piece container, where each piece can be of the same or differing material depending upon article design, fragility, material and weight.

As shown in FIGS. 9–11, the outer container, consisting of panels 41 through 45, fits snugly around the inner tray cap assembly 60 and the article top, sides and bottom. Tray-cap 60 includes a top wall 61 which is longer and wider than the article top and extends beyond the outer perimeter of the edges of the article top. The tray-cap 60 is located over and on the article top, and includes depending side walls, such as shown at 62 and 63, which surround the article top edges. Panel 41 of the blank is located over and on top of tray-cap 60 and the article top, extending from edge to edge of the tray-cap and the blank, and from the center of tray-cap 60 and terminating near the top edge of the article first side. Panel 41 is connected along a bend line 51 to the blank first side panel 42. The first side panel 42 extends from blank edge to edge and downwardly across the article first side and terminates near the article bottom first side edge and is connected along a bend line 52 to blank bottom panel 43. The bottom panel 43 extends from blank edge to edge and across the article bottom and terminates at the bottom edge of the article second side, and is connected along a bend line 53 to the second side panel 44. The second side panel 44 extends from blank edge to edge and upwardly across the article second side and terminates near the article top edge, and is connected along a bend line 54 to the top panel 45. Top panel 45 of the blank extends from blank edge to edge and across the top of tray-cap 60 and the article top and terminates in the center of tray-cap top surface 61 with its edge butted against the edge of panel 41 of the blank.

FIGS. 10 and 11 show how the article, such as a sink S, is restrained from motion within the shipping container. The article is held within the tray-cap 60 and the tray-cap is held within the container blank through any of the securing and closure methods to be explained. FIG. 11 shows a band, cord or tape 70 as a closure method. A series of slots 71-74 formed in panels 41-45 in the blank line up to receive and retain the band, cord or tape in position. The restraining of the article within the container, which is larger than and encloses the sensitive article edges, obviates the need for container end walls.

Figure 12:
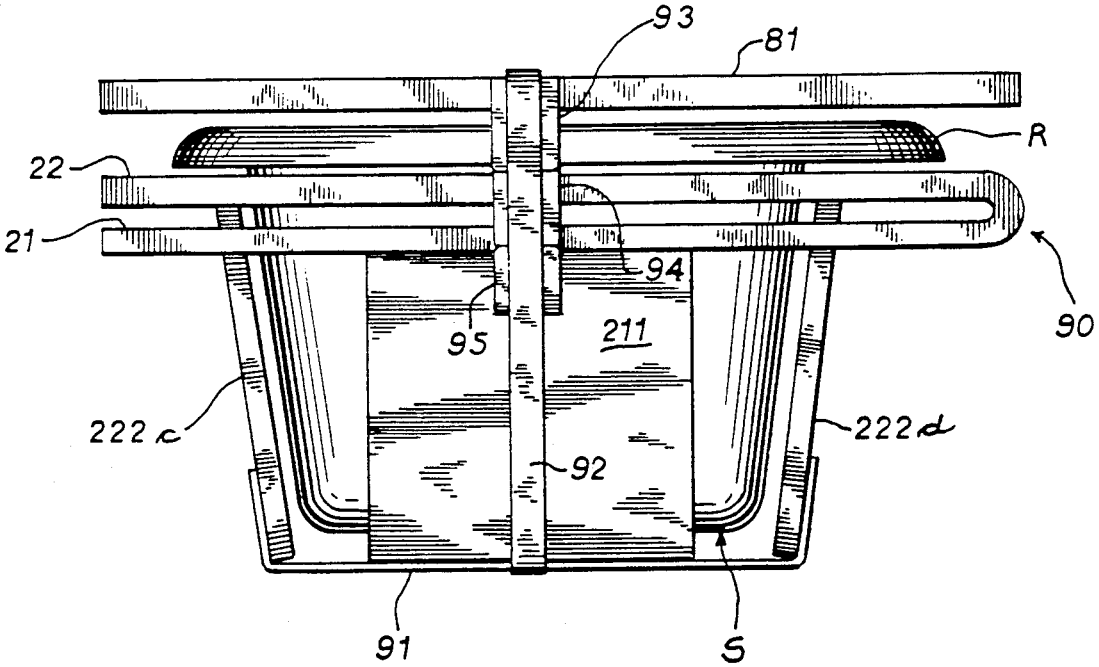
FIG. 12 is an end view of a shipping container similar to that shown in FIGS. 6–8 but with side and bottom panels removed so as to form a container which exposes article sides, bottom and ends to all handlers and shippers.

The embodiment of FIG. 12 consists of two blanks and three panels or one blank and three panels, where each blank can be of the same or differing materials. The top rim R of the article, such as a sink S, is "sandwiched" between a top panel 81 which is placed on top of rim R and is longer and wider than the article top, and a double cavitied panel assembly, shown generally at 90. Panel assembly 90 is formed from a pair of folded cavitied panels substantially identical in construction to panels 21 and 22, shown in FIG. 6, in which flaps 210 and 211 are placed against the ends of sink S and flaps 222*a*-222*d* are placed against the sides of sink S. Flaps 216 and 217 are placed against the bottom of sink S. Side flaps 222*a*-222*d* are secured to each other by strips of tape, such as shown at 91, extending across bottom flaps 216 and 217. A longitudinal band 92 secures top panel 81 and panel assembly 90 together. Tabs, such as shown at 93, 94 and 95 are formed out of portions of panels 81, 22 and 21, respectively. Strap 92 bears against tabs 93-95 to prevent contact of strap 92 with sink S.

The design of FIG. 12 lends itself to unitized load shipments for more efficient handling, material conservation, shipping and storage. The container can be closed (sealed or secured) using any number of available means provided that the material is capable of withstanding the handling and shipping environment to which the container is subjected. Typical examples suitable for these containers include, without limitation, adhesives, banding (plastic or steel), plastic film or netting (stretch or shrink), staples, tape, cord and combinations of either or all, etc. The closure method is dependent on the container design, material and the environment of handling, shipping and storage.

The shipping containers shown in FIGS. 5, 8 10 and 11 can be made from many types of known folding board and materials, provided the material is capable of withstanding the loads and environment to which the particular container is to be subjected. Typical examples of materials suitable for these articles, without limitation, include fiber board, corrugated board (single or double face) made from fiber board or plastic sheeting; foldable and formable plastic foam sheeting; wood, veneer and wire combination; etc. The selection of the material is determined by the design, fragility, weight and material of the article to be packed.

All embodiments of FIGS. 5, 8 and 11 can be nested for more efficient utilization of product space requirements because of the trapezoidal design allowing for the mating of the angular sides with a corresponding side of the adjacent containers.

All the embodiments conserve packaging material, labor, energy and waste disposal problems. The open-ended construction results in a minimum number of seams which must be secured in constructing the container. It also obviates the need for end walls and shipping spacers thereby minimizing packaging materials. The reduction in packaging materials also conserves material storage space both at the container manufacturer and the user's packaging material warehouse and production packaging line. Another important advantage of a shipping container of the invention is that any automated packaging machinery can be designed more simply thereby reducing the need for secondary materials and energy usage.

It will be apparent to those skilled in the science that various modifications to the preferred embodiment, in addition to those mentioned above are possible without departing from the scope or spirit of the invention; as shown in FIGS. 1-5 the second cavitied panel could be eliminated or another cavitied panel added between panels 3 and 4 so that panel 3 and the new cavitied panel would each have their own article end and bottom protectors. Also referring to FIG. 12, the top panel and/or cavitied panels could consist of one or more panels per blank or all top panels could be combined with the cavitied panels into one blank for layered or accordion folding. It may also be desirable to protect the enclosed article from dirt or dust by placing the article or package article in a transparent bag or wrapper. Therefor the scope of the invention is not to be limited to the description of the preferred embodiments of articles mentioned above.

I claim:

1. A shipping container for an article with a top rim, comprising:

a top panel which is longer and wider than the article top rim such that the edges of the top panel extend a predetermined distance beyond all edges of the periphery of the article top rim;

a first cavitied panel constructed to extend across, under and beyond the article top rim underside from a first side of the article to a second side of the article;

a second cavitied panel connected to the first cavitied panel adjacent a side edge of the first cavitied panel, the second cavitied panel being constructed to be layer folded against the first cavitied panel and to extend across and beyond the outside edges of the top rim;

a pair of side flaps formed by cuts and bend lines in one of the cavitied panels, the side flaps being constructed to fold down along and against the article sides;

a pair of end flaps formed by cuts and bend lines in the other of the cavitied panels, the end flaps being constructed to fold down along and against the article ends; and a pair of bottom flaps formed with one of the pairs of side or end flaps for placement against the bottom of the article.

2. The shipping container as in claim 1, wherein the first cavitied panel is connected to the top panel adjacent a side edge of the top panel.

3. The shipping container as in claim 1, further comprising a third cavitied panel connected to the second cavitied panel and being constructed to be layer folded against the second cavitied panel, and wherein one of the side flaps is formed in the first cavitied panel, one of the side flaps is formed in the second cavitied panel, and the end flaps are formed in the third cavitied panel.

4. An open-ended shipping container for an article having a top rim, comprising:

a first cavitied panel which is longer and wider than the underside of the article top rim outer perimeter and surrounds the under-outer sides of the article under and near the article top rim, the first cavitied panel having a pair of end flaps formed by cuts and bending lines which are suitable to fold down and under the article ends and bottom for protection of the article;

a second cavitied panel connected to the first cavitied panel adjacent a side edge of the second cavitied panel and extending across the article top underside surface and layer folded over the first cavitied panel, the second cavitied panel having a pair of side flaps formed by cuts and bending lines which are suitable to fold down against the article sides;

a first side panel connected to the second cavitied panel adjacent an edge of the second cavitied panel, the first side panel extending across the article first side from the article top underside to the bottom of the article;

a bottom panel connected to the first side panel adjacent an edge of the first side panel, the bottom panel being suitable to extend across the article bottom from the article first side to its second side;

a second side panel connected to the bottom panel adjacent an edge of the bottom panel, the second side panel extending across the article second side from the article bottom to its top;

a top panel connected to the second side panel adjacent a top edge of the second side panel, the top panel being suitable to extend across the article top from the article second side to its first side top edge; and a closure panel connected to a side edge of the top panel adjacent to the first side edge and which extends over at least a top portion of the outer surface of the first side panel.

5. A shipping container as in claim 4, further comprising a separated tray-cap which is longer and wider than the article top perimeter suitable to surround and extend beyond all edges of the article top, the tray-cap being retained in its position by covering and surrounding the article top rim and its edges.

6. A shipping container for an article with a top rim, comprising:

a top panel which is longer and wider than the article top rim such that the edges of the top panel extend a predetermined distance beyond all edges of the periphery of the article top rim;

a cavitied panel adapted to receive the article therewithin and constructed to extend a predetermined distance beyond all edges of the periphery of the article top rim, the cavitied panel being adapted for placement adjacent the underside of the rim;

a pair of opposed flaps formed by cuts and bend lines in portions of the cavitied panel, the pair of flaps being constructed to fold downwardly along opposite side portions of the article located below the article top rim; and an elongated binding member engageable with the top panel and the pair of flaps to secure the container about the article.

7. The shipping container of claim 6, further comprising a second cavitied panel disposed adjacent the first cavitied panel, and a second pair of opposed flaps formed by cuts and bend lines in the second cavitied panel, the second pair of flaps being constructed to fold downwardly along opposite side portions of the article located below the article top rim.

8. The shipping container of claim 7, wherein the first-mentioned and second cavitied panels are connected to each other.

* * * * *